US010145630B2

(12) United States Patent
Fukumoto et al.

(10) Patent No.: US 10,145,630 B2
(45) Date of Patent: Dec. 4, 2018

(54) ALUMINUM ALLOY FIN MATERIAL FOR HEAT EXCHANGERS, AND METHOD OF PRODUCING THE SAME

(71) Applicant: UACJ Corporation, Tokyo (JP)

(72) Inventors: Atsushi Fukumoto, Tokyo (JP); Junichi Mochizuki, Tokyo (JP); Akio Niikura, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 117 days.

(21) Appl. No.: 14/987,137

(22) Filed: Jan. 4, 2016

(65) Prior Publication Data

US 2016/0116235 A1 Apr. 28, 2016

Related U.S. Application Data

(63) Continuation of application No. PCT/JP2014/067972, filed on Jul. 4, 2014.

(30) Foreign Application Priority Data

Jul. 5, 2013 (JP) ..... 2013-142157

(51) Int. Cl.
*C22C 21/00* (2006.01)
*F28F 21/08* (2006.01)
(Continued)

(52) U.S. Cl.
CPC ..... *F28F 21/084* (2013.01); *B22D 11/0622* (2013.01); *C21D 1/26* (2013.01);
(Continued)

(58) Field of Classification Search
CPC ..... B22D 11/0622; C21D 1/26; C22C 21/00; C22C 21/02; C22C 21/10; C22F 1/00;
(Continued)

(56) References Cited

U.S. PATENT DOCUMENTS 6,165,291 A * 12/2000 Jin ..... B22D 11/0622 148/551
2003/0015573 A1* 1/2003 Kawahara ..... B22D 11/0622 228/183

(Continued)

FOREIGN PATENT DOCUMENTS

CN 1401011 A 3/2003
CN 102352456 A 2/2012

(Continued)

OTHER PUBLICATIONS

Chinese Office Action and Search Report, dated Oct. 19, 2016, for corresponding Chinese Application No. 201480029083.5, with an English translation.

(Continued)

*Primary Examiner* — Veronica F Faison
(74) *Attorney, Agent, or Firm* — Birch, Stewart, Kolasch & Birch, LLP

(57) ABSTRACT

An aluminum alloy fin material for heat exchangers, containing 0.5 to 1.5 mass % of Si; 0.1 to 1.0 mass % of Fe; 0.8 to 1.8 mass % of Mn; and 0.4 to 2.5 mass % of Zn, with the balance being Al and unavoidable impurities, wherein a metallographic microstructure before braze-heating is such that a density of second phase particles having a circle-equivalent diameter of less than 0.1 μm is less than $1\times10^7$ particles/mm$^2$, and that a density of second phase particles having a circle-equivalent diameter of 0.1 μm or more is $5\times10^4$ particles/mm$^2$ or more, wherein a tensile strength before braze-heating, $TS_B$ (N/mm$^2$), a tensile strength after braze-heating, $TS_A$ (N/mm$^2$), and a sheet thickness of the fin material, t (μm), satisfy a relationship: $0.4\leq(TS_B-TS_A)/t\leq2.1$, and wherein the sheet thickness is 150 μm or less; and a method of producing the same.

3 Claims, 1 Drawing Sheet

(51) Int. Cl.

| | |
|---|---|
| ***B22D 11/06*** | (2006.01) |
| ***C22F 1/04*** | (2006.01) |
| ***C22C 21/02*** | (2006.01) |
| ***C22C 21/10*** | (2006.01) |
| ***F28F 1/12*** | (2006.01) |
| ***C21D 1/26*** | (2006.01) |
| ***C22F 1/043*** | (2006.01) |
| ***C22F 1/053*** | (2006.01) |
| *C22F 1/00* | (2006.01) |
| *F28F 1/02* | (2006.01) |

(52) U.S. Cl.
CPC ..... *C22C 21/00* (2013.01); *C22C 21/02* (2013.01); *C22C 21/10* (2013.01); *C22F 1/04* (2013.01); *C22F 1/043* (2013.01); *C22F 1/053* (2013.01); *F28F 1/126* (2013.01); *C22F 1/00* (2013.01); *F28F 1/02* (2013.01); *F28F 2275/04* (2013.01)

(58) Field of Classification Search
CPC .. C22F 1/04; C22F 1/043; C22F 1/053; F28F 1/02; F28F 1/126; F28F 21/084; F28F 2275/04
See application file for complete search history.

(56) References Cited

U.S. PATENT DOCUMENTS

2004/0086417 A1* 5/2004 Baumann ..... C22C 21/00 420/531
2004/0182482 A1* 9/2004 Gray ..... C22F 1/04 148/439
2005/0034793 A1* 2/2005 Henry ..... B22D 11/003 148/551
2005/0150642 A1* 7/2005 Baumann ..... B22D 11/003 165/152
2007/0113936 A1 5/2007 Oki et al.
2008/0118393 A1 5/2008 Oskarsson et al.
2009/0308500 A1* 12/2009 Suzuki ..... C22C 21/10 148/523
2012/0261037 A1 10/2012 Suzuki et al.
2013/0156634 A1* 6/2013 Howells ..... B22D 11/12 420/531
2015/0107731 A1 4/2015 Suzuki et al.
2015/0252461 A1* 9/2015 Kokubo ..... C22C 21/02 148/551

FOREIGN PATENT DOCUMENTS

| | | | |
|---|---|---|---|
| JP | 6-212370 | A | 8/1994 |
| JP | 10-330897 | A | 12/1998 |
| JP | 2005-220375 | A | 8/2005 |
| JP | 2007-31778 | A | 2/2007 |
| JP | 2008-38166 | A | 2/2008 |
| JP | 2008-190027 | A | 8/2008 |
| JP | 2008-308760 | A | 12/2008 |
| JP | 2008-308761 | A | 12/2008 |
| JP | 2009-293059 | A | 12/2009 |
| JP | 2012-126950 | A | 7/2012 |

OTHER PUBLICATIONS

International Search Report, issued in PCT/JP2014/067972, dated Aug. 26, 2014.
Written Opinion of the International Searching Authority, issued in PCT/JP2014/067972, dated Aug. 26, 2014.

* cited by examiner

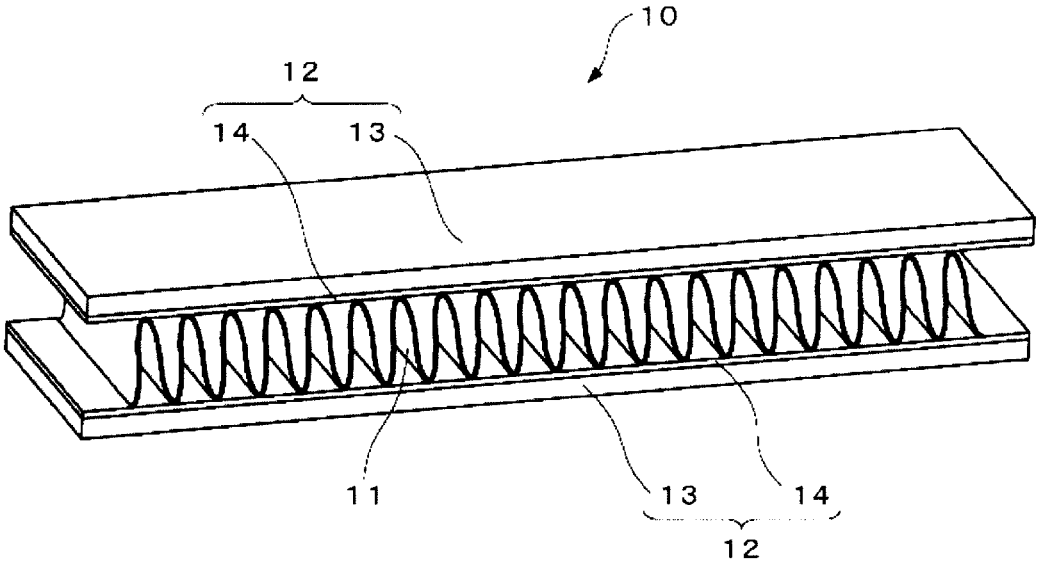
10
12
14
13
11
13
14
12

ALUMINUM ALLOY FIN MATERIAL FOR HEAT EXCHANGERS, AND METHOD OF PRODUCING THE SAME

CROSS-REFERENCE TO RELATED APPLICATIONS

This application is a Continuation of PCT International Application No. PCT/JP2014/067972 filed on Jul. 4, 2014, which claims priority under 35 U.S.C. § 119 (a) to Japanese Patent Application No. 2013-142157 filed in Japan on Jul. 5, 2013. Each of the above applications is hereby expressly incorporated by reference, in its entirety, into the present application.

TECHNICAL FIELD

The present invention relates to an aluminum alloy fin material for heat exchangers, which is particularly preferably used as a fin material for heat exchangers, such as radiators, heater cores, condensers, and intercoolers, and which is excellent in formability into a corrugation forming property and excellent in mechanical strength after braze-heating; and also relates to a method of producing the same.

BACKGROUND ART

An aluminum alloy is lightweight and has high heat conductivity, and thus it is used in a heat exchanger for an automobile, for example, a radiator, a condenser, an evaporator, a heater core, or an intercooler.

In such a heat exchanger, for example, it has been, heretofore, utilized a fin of an aluminum alloy that has been formed in a corrugated form by corrugation forming, in a state of being brazed (braze-joined). Regarding the aluminum alloy fin material, use has been usually made of: pure aluminum-based alloys excellent in thermal conductivity, such as JIS 1050 alloys; and Al—Mn-based alloys excellent in mechanical strength and buckling resistance, such as JIS 3003 alloys.

In recent years, there is an increasing demand for weight reduction, size reduction, and performance enhancement, for heat exchangers. Along with this demand, it is particularly desired for aluminum alloy fin materials that are brazed, to have a small thickness and to have excellent characteristics, such as mechanical strength after braze-heating, thermal conductivity, and corrosion resistance.

However, as making the fin material thinner (sheet metal gauging of the fin material) proceeds, enhancement in mechanical strength is also demanded. Along with that demand, there occurs a problem that the mechanical strength before braze-heating enhances, and it is difficult to have a predetermined dimension when the fin material is worked into a fin by corrugation forming.

Patent Literature 1 proposes a high-mechanical strength aluminum alloy fin material having a sheet thickness of 40 to 200 μm, which is cast by a twin belt-type continuous casting and rolling method, and which has a fibrous microstructure before braze-heating. However, since recrystallization is not carried out upon intermediate annealing, and the metallographic microstructure before braze-heating is a fibrous microstructure, the strain amount of the fin material in the raw material state is made large. As a result, the raw material strength is made high, and when a fin material having a small thickness is subjected to corrugation working, a predetermined dimensional accuracy cannot be obtained, and there is a risk that the performance of the resultant heat exchanger may deteriorate.

Patent Literature 2 proposes a drooping resistant fin material having a sheet thickness of less than 0.2 mm, which is obtained by: casting the raw material by a twin roll-type continuous casting and rolling method; setting the final cold-rolling reduction ratio to 60% or more; and subjecting the fin material having the final sheet thickness to final annealing. However, in order to suppress drooping upon the braze-heating, final cold-rolling is carried out at a rolling reduction ratio of 60% or more, and the raw material strength before the braze-heating is further set by the final annealing. As a result of carrying out the annealing, flatness in the coil's transverse becomes conspicuously poor, and the product quality or productivity upon the final slitting step is deteriorated to a large extent.

Patent Literature 3 proposes a high mechanical strength aluminum alloy material for an automotive heat exchanger having a final sheet thickness of 0.1 mm or less and having excellent formability and erosion resistance, which is obtained by: casting by a continuous casting and rolling method, and in which the proportion of a fibrous microstructure in the microstructure before braze-heating is 90% or more or 10% or less, and in which the density of dispersed particles having a circle-equivalent diameter of 0.1 to 5 μm in the aluminum alloy material surface before braze-heating is defined. However, although the proportion of the fibrous microstructure in the microstructure before braze-heating is defined, if the fibrous microstructure remains as described above, the raw material strength is made high, and there is a risk that the corrugation formability may be deteriorated. Further, if a recrystallized microstructure has no residual fibrous microstructure, it is necessary to set the temperature of the intermediate annealing to a high temperature. Thus, second phase particles become coarse upon the annealing to have a sparse distribution, and the mechanical strength after braze-heating is lowered.

Patent Literature 4 proposes a method of producing a high strength aluminum alloy material for an automotive heat exchanger having a final sheet thickness of 0.1 mm or less and having excellent erosion resistance, the method containing: casting the alloy raw material by a continuous casting and rolling method; and carrying out the first annealing at a temperature of 450° C. to 600° C. for 1 to 10 hours. However, since the intermediate annealing is carried out at a high temperature, second phase particles become coarse upon the annealing to have a sparse distribution as described above, and the mechanical strength after braze-heating is lowered.

Patent Literature 5 proposes an aluminum alloy fin material for a heat exchanger having a final sheet thickness of 40 to 200 μm, which is obtained by: casting the fin raw material by a twin belt-type continuous casting method; and carrying out first intermediate annealing at a temperature of 250° C. to 550° C. and second intermediate annealing at a temperature of 360° C. to 550° C. However, no metallographic microstructure before braze-heating is defined, the raw material strength is made high, and thus, there is a possibility that the corrugation formability may be deteriorated.

Further, in Patent Literatures 1 and 5, a twin belt-type continuous casting and rolling method is employed as the casting method. However, a twin belt system is characterized in that the cooling speed at the time of casting is slower than a twin roll system due to the difference in the casting method. Thus, for example, when an alloy containing Fe is cast, since Fe has a very low solid solubility in aluminum, most of Fe is crystallized out at the time of casting to form Al—Fe-based second phase particles (for example, Al—Fe—Si-, Al—Fe—Mn-, and Al—Fe—Mn—Si-based compounds) in aluminum. Thus, when an alloy containing these elements is cast, the second phase particles are crystallized out in a coarse state, and there is a high possibility for accelerating abrasion of the die at the time of corrugation forming, which is industrially not preferable.

CITATION LIST

Patent Literature

Patent Literature 1: JP-A-2007-031778 ("JP-A" means unexamined published Japanese patent application)
Patent Literature 2: JP-A-2008-190027
Patent Literature 3: JP-A-2008-308760
Patent Literature 4: JP-A-2008-308761
Patent Literature 5: JP-A-2008-038166

SUMMARY OF INVENTION

Technical Problem

The present invention was attained in view of such problems, and is contemplated for providing: an aluminum alloy fin material, which has a satisfactory corrugation formability, which has excellent mechanical strength after braze-heating, and which can be particularly preferably used as a fin material for an automotive heat exchanger; and a method of producing the same.

Solution to Problem

The inventors of the present invention conducted an investigation on the problems described above, and as a result, the inventors of the present invention found that when the metallographic microstructure of a fin material having a particular alloy composition is controlled, and when the ratio between the sheet thickness and the mechanical strength before braze-heating of the fin material is regulated, a fin material can be obtained, which is particularly preferably as a fin material for an automotive heat exchanger. Then, the inventors of the present invention completed the present invention based on these findings.

That is, the present invention provides the following means:

(1) An aluminum alloy fin material for heat exchangers, containing 0.5 to 1.5 mass % of Si; 0.1 to 1.0 mass % of Fe; 0.8 to 1.8 mass % of Mn; and 0.4 to 2.5 mass % of Zn, with the balance being Al and unavoidable impurities, wherein a metallographic microstructure before braze-heating is such that a density of second phase particles having a circle-equivalent diameter of less than 0.1 μm is less than $1\times10^7$ particles/mm$^2$, and that a density of second phase particles having a circle-equivalent diameter of 0.1 μm or more is $5\times10^4$ particles/mm$^2$ or more, wherein a tensile strength before braze-heating, $TS_B$ (N/mm$^2$), a tensile strength after braze-heating, $TS_A$ (N/mm$^2$), and a sheet thickness of the fin material, t (μm), satisfy a relationship: $0.4\leq(TS_B-TS_A)/t\leq2.1$, and wherein the sheet thickness is 150 μm or less.

(2) A method of producing an aluminum alloy fin material for heat exchangers, containing:

casting an aluminum alloy raw material containing: 0.5 to 1.5 mass % of Si; 0.1 to 1.0 mass % of Fe; 0.8 to 1.8 mass % of Mn; and 0.4 to 2.5 mass % of Zn, with the balance being Al and unavoidable impurities, by a twin roll-type continuous casting and rolling method;

at least one intermediate annealing, in which a first annealing of the intermediate annealing is carried out in two stages at different retention temperatures, a retention temperature of a second stage is higher than a retention temperature of a first stage, the retention temperature of the first stage is 300° C. to 450° C., the retention temperature of the second stage is 430° C. to 580° C.; and final cold-rolling at a rolling reduction ratio of 20% to 60%, after performing the intermediate annealing;

wherein a metallographic microstructure before braze-heating is such that a density of second phase particles having a circle-equivalent diameter of less than 0.1 μm is less than $1\times10^7$ particles/mm$^2$, and that a density of second phase particles having a circle-equivalent diameter of 0.1 μm or more is $5\times10^4$ particles/mm$^2$ or more, wherein a tensile strength before braze-heating, $TS_B$ (N/mm$^2$), a tensile strength after braze-heating, $TS_A$ (N/mm$^2$), and a sheet thickness of the fin material, t (μm), satisfy a relationship: $0.4\leq(TS_B-TS_A)/t\leq2.1$, and wherein the sheet thickness is 150 μm or less.

(3) The method of producing an aluminum alloy fin material for heat exchangers according to (2), wherein a cooling speed from the time point of completion of a retention for annealing of the second stage to 250° C. is set to 50° C./hour or less.

Advantageous Effects of Invention

According to the present invention, the aluminum alloy fin material can be provided, which has a satisfactory corrugation formability, which has excellent mechanical strength after braze-heating, which has a small thickness, and which can be preferably used particularly as a fin for an automotive heat exchanger; and a method of producing the fin material can be provided.

Other and further features and advantages of the invention will appear more fully from the following description, appropriately referring to the accompanying drawings.

BRIEF DESCRIPTION OF DRAWING

FIG. 1 is a perspective view schematically illustrating a corrugation-formed test material as produced in Examples.

DESCRIPTION OF EMBODIMENTS

Alloy Composition

First, the reasons for adding the alloying elements of the aluminum alloy fin material of the present invention and the ranges of the amounts of addition thereof, will be explained. Hereinafter, the unit percent (%) is percent (%) by mass, unless otherwise specified.

Si contributes to enhance the mechanical strength through dispersion strengthening by forming Al—Fe—Si-based, Al—Mn—Si-based, and Al—Fe—Mn—Si-based compounds together with Fe and Mn, or through solid-solution strengthening by being solid solubilized in the matrix. The content of Si according to the present invention is 0.50 to 1.5%. If the content of Si is within this range, the effects described above can be obtained. Further, if the content of Si is too large, the solidus temperature (melting point) of the resultant material is lowered, thereby the possibility for melting at the time of brazing may increase, and at the same time, the amount of solid solution in the matrix increases, to lower the thermal conductivity. A more preferred content of Si is 0.80% to 1.4%.

Fe enhances the high-temperature strength, and has an effect of preventing deformation at the time of braze-heating. When a twin roll-type casting and rolling method is used, the Al—Fe—Si-based, Al—Fe—Mn-based, and Al—Fe—Mn—Si-based compounds that are formed by Fe together with Si and Mn are finely dispersed, and Fe contributes to enhance the mechanical strength through the dispersion strengthening. Further, Fe has an effect of coarsening the grains after brazing by means of the role of suppressing nucleation at the time of brazing, and has an effect of suppressing solder diffusion. The content of Fe according to the present invention is 0.10 to 1.0%. If the content of Fe is too small, the effects above become small, and a high-purity virgin aluminum ingot must be utilized, to cause the costs high. Further, if the content of Fe is too large, huge intermetallic compounds are generated at the time of casting, to lower plastic workability, and to wear the die at the time of corrugation forming. Further, the number of cathode sites is made larger, to increase the number of corrosion starting points, to lower the self-corrosion resistance. A more preferred content of Fe is 0.20 to 0.90%.

Mn contributes to enhance the mechanical strength through dispersion strengthening by forming Al—Mn—Si-based and Al—Fe—Mn—Si-based compounds together with Si and Fe, or through solid-solution strengthening by being solid solubilized in the matrix. Further, since Mn has an effect of lower the amount of Si solid solution, melting at the time of brazing can be suppressed by raising the solidus temperature (melting point) of the resultant material. The content of Mn according to the present invention is 0.80 to 1.8%. If the content of Mn is too small, the effects described above are insufficient. Further, if the content of Mn is too large, huge intermetallic compounds are generated at the time of casting, to lower plastic workability, and the solid solution amount in the matrix is made large, thereby for lowering the thermal conductivity. A more preferred content of Mn is 1.0 to 1.6%.

Zn has an effect of enhancing the sacrificial anode effect, by lowering the natural potential of the resultant fin. The content of Zn according to the present invention is 0.40 to 2.5%. If the content of Zn is too small, the effects described above are small. Further, if the content of Zn is too large, the corrosion speed is made faster, and the self-corrosion resistance of the resultant fin is deteriorated. Further, if the content of Zn is too large, the amount of solid solution of Zn in the matrix is made large, to lower the thermal conductivity. A more preferred content of Zn is 0.50 to 1.5%.

Further, the contents of the unavoidable impurities contained in the fin material of the present invention are, respectively, 0.05% or less, and the total amount is preferably 0.15% or less.

(Metallographic Microstructure Before Braze-Heating)

The metallographic microstructure before braze-heating of the aluminum alloy fin material of the present invention will be explained.

Fine second phase particles (for example, Al—Mn-, Al—Mn—Si-, Al—Fe—Si-, and Al—Fe—Mn—Si-based compounds) having a circle-equivalent diameter of less than 0.1 μm, have an effect of suppressing nucleation of recrystallization, upon the recrystallization of the fin at the time of braze-heating. Thus, if the density of those second phase particles is high, the recrystallization does not easily occur. Then, the recrystallization is not completed before the solder melts, the solder penetrates into the fin, and thereby erosion occurs. In order to suppress such an erosion, it is effective to enhance the driving force for the recrystallization of the fin at the time of braze-heating. In order to do so, raising the final cold-rolling reduction ratio at the time of fin material production can be mentioned as a countermeasure. However, when the final cold-rolling reduction ratio is raised, the strain amount introduced into the material is made large, to enhance the mechanical strength before braze-heating, thereby for deteriorating the corrugation formability. Thus, in the present invention, the density of the second phase particles having a circle-equivalent diameter of less than 0.1 μm is less than $1\times10^7$ particles/mm$^2$. A more preferred density is less than $5\times10^6$ particles/mm$^2$. The "second phase" as referred to in the present invention means a phase other than the matrix, and the "second phase particles" means particles of intermetallic compounds such as described above, which are not the matrix.

Second phase particles (for example, Al—Mn-, Al—Mn—Si-, Al—Fe—Si-, and Al—Fe—Mn—Si-based compounds) having a circle-equivalent diameter of 0.1 μm or more, have a relatively large size, and thus those second phase particles are solid solubilized at the time of braze-heating and are not easily lost. Thus, since the second phase particles remain in the fin even after braze-heating, dispersion strengthening has an effect of enhancing the fin strength after braze-heating. Thus, in the present invention, the density of the second phase particles having a circle-equivalent diameter of 0.1 μm or more is $5\times10^4$ particles/mm$^2$ or more. A more preferred density of the second phase particles having a circle-equivalent diameter of 0.1 μm or more is $1\times10^5$ particles/mm$^2$ or more but $1\times10^7$ particles/mm$^2$ or less.

The sizes (circle-equivalent diameters) and the numbers (densities) of dispersed particles in a fin material cross-section before and after brazing, are obtained by making an observation of the fin material by means of transmission electron microscopy (TEM) and scanning electron microscopy (SEM).

The density of the second phase particles having a circle-equivalent diameter of less than 0.1 μm can be investigated by making a TEM observation. The film thickness of an observed area can be measured from equal-thickness fringes, and TEM observation can be made only at sites where the film thickness would be 0.1 to 0.3 μm. TEM observation can be carried out by taking photographs in three viewing fields at a magnification of 100,000 folds. Further, the density of the second phase particles having a circle-equivalent diameter of 0.1 μm or more can be investigated by making a SEM observation of a fin material cross-section. SEM observation can be carried out by taking photographs in three viewing fields at a magnification of 5,000 folds. The size (circle-equivalent diameter) and the density of the second phase particles before braze-heating can be determined by subjecting the TEM and SEM photographs to an image analysis ("A ZO" KUN, manufactured by Asahi Kasei Engineering Corp.).

In the present invention, it is preferable that the microstructure before braze-heating is composed of a recrystallized microstructure, and that the grain size is 1,000 μm or less. In the case where the recrystallization is not achieved by the intermediate annealing, and where a fiber microstructure (fibrous microstructure) remains, the mechanical strength of the fin material before heating becomes high, and the corrugation formability is deteriorated. Also, the grain size of the recrystallized grains formed by the intermediate annealing is preferably 1,000 μm or less. When the grain size is more than 1,000 μm, in the case where grain boundaries exist in the vicinity of the apexes of fin ridges formed when corrugation forming is performed, the fin is bent at the grain boundaries, and the fluctuation in the ridge height of the fin that is finally obtained is made large. Further, in the production of the fin material, as flatness of the material is deteriorated, rolling property is inhibited, and the product quality and productivity of the fin material are deteriorated. A more preferred grain size is 500 μm or less.

(Tensile Strength and Sheet Thickness)

The relationship among the tensile strength before braze-heating, $TS_B$ (N/mm$^2$), of the fin material of the present invention, the tensile strength after braze-heating, $TS_A$ (N/mm$^2$), and the sheet thickness of the fin material, t (μm), will be explained.

When a fin material is corrugated into a waveform fin having a predetermined R value, the strain amount at the formed fin ridges is determined by the R value and the sheet thickness of the fin material at the time of waveform forming. The strain distribution in the fin sheet thickness direction is such that the strain in the outermost layer is large, and the strain lowers toward the center of the sheet thickness. Thus, the vicinity of the surface layer is subjected to plastic deformation, and the vicinity of the sheet thickness center is subjected to elastic deformation. When the proportion of this plastic deformation region is small, the formed shape cannot be frozen, and the formed fin ridges spring back, so that a predetermined shape is not obtained.

When the R value of the fin ridges is constant, as the sheet thickness of the fin material becomes thinner, the strain amount of the outermost layer of the fin ridges lowers. Thus, if the mechanical strength of the fin material before braze-heating is high, the proportion of the plastic deformation region in the fin sheet thickness direction becomes smaller. Thus, in order to perform satisfactory corrugation forming, if the fin material sheet thickness is small, it is necessary to lower the mechanical strength of the fin material before braze-heating.

On the other hand, if the difference in mechanical strength ($TS_B$−$TS_A$) of the mechanical strength after braze-heating, that is, mechanical strength in the O-material state, and the mechanical strength before braze-heating is too small, the strain amount introduced to the fin material before braze-heating become lowered. If the strain amount in the raw material state is small, the driving force of recrystallization at the time of braze-heating become small, and the recrystallization temperature rises to a high temperature, or recrystallization is not sufficiently completed, and erosion occurs due to molten solder.

Thus, in the present invention, it is preferable that the tensile strength before braze-heating, $TS_B$ (N/mm$^2$), the tensile strength after braze-heating, $TS_A$ (N/mm$^2$), and the sheet thickness of the fin material, t (μm), satisfy the following relationship:

$$0.4 \leq (TS_B - TS_A)/t \leq 2.1 \quad \text{Formula 1}$$

In order to satisfy the relationship of formula 1, the alloy composition of the alloy material may be set as described above. Further, as explained above, for the alloy material before braze-heating, when the metallographic microstructure has a recrystallized structure, the grain size is adjusted to 1,000 μm or less, and strain is generated by a predetermined cold rolling reduction ratio, a fin material having satisfactory formability and brazing property can be obtained. In order to suppress erosion of the fin at the time of brazing, whether there is more than the necessary amount of strain may present in the fin after performing corrugation forming is important. The strain amount of the fin after corrugation forming is the sum of the strain amount of the alloy material, ($TS_B$−$TS_A$), and the strain amount introduced at the time of corrugation forming. It was found that since the surface layer strain amount of a corrugation formed fin becomes small as the sheet thickness t becomes smaller, the value of ($TS_B$−$TS_A$)/t serves as an important indicator for the suppression of erosion.

After braze-heating, when the retention temperature of the intermediate annealing (the annealing temperature) is set in at least two stages, the latter stage is performed at a higher temperature than the former stage, and thereby the density of the second phase particles having a particle size of 0.1 μm or more becomes larger, the mechanical strength can be prevented from being too low. By performing annealing in two stages as such, even if the value of ($TS_B$−$TS_A$) is small, erosion of the fin does not occur, and a fin material having satisfactory formability can be obtained. Also, a fin material which satisfies the formula 1 in connection with the mechanical strengths before braze-heating and after braze-heating can be prepared.

If ($TS_B$−$TS_A$)/t is smaller than 0.4, the driving force of recrystallization at the time of braze-heating is small, to occur erosion. If ($TS_B$−$TS_A$)/t is larger than 2.1, when corrugation forming is performed, the proportion of the plastic deformation region in the sheet thickness direction of the fin ridges becomes small, springback occurs, and the corrugation forming property is deteriorated. A more preferred range of ($TS_B$−$TS_A$)/t is 0.5 to 2.0.

The sheet thickness of the aluminum alloy fin material for a heat exchanger of the present invention is 150 μm or less, preferably 40 to 100 μm, and more preferably 40 to 80 μm. In the present invention, the aluminum alloy fin material has a feature that the fin material can be made particularly thin.

(Production Method)

Next, the production method of the present invention of the aluminum alloy fin material will be described.

First, an aluminum alloy raw material having the composition described above is melted, and a sheet-shaped ingot is produced by a twin roll-type continuous casting and rolling method. A twin roll-type continuous casting and rolling method is a method of: supplying molten aluminum metal between a pair of water-cooled rolls through a molten-metal supplying nozzle made of a refractory material; and continuously casting and rolling a thin sheet, and examples include a Hunter's method and a 3C method.

In a twin roll-type continuous casting and rolling method, the cooling speed at the time of casting is larger by several times to several hundred times than that of a DC (Direct Chill) casting method or a twin belt-type continuous casting method. For example, while the cooling speed in the case of a DC casting method is 0.5 to 20° C./sec., the cooling speed in the case of the twin roll-type continuous casting and rolling method is 100 to 1,000° C./sec. Accordingly, the twin roll-type method has a feature that crystallization products, for example, of Al—Fe—Si-based, Al—Fe—Mn-based, and Al—Fe—Mn—Si-based compounds produced at the time of casting, are dispersed more finely and more densely, as compared to the DC casting method or the twin belt-type continuous casting and rolling method. These crystallization products dispersed at a high density accelerate precipitation of elements that are solid-solubilized in the matrix, such as Mn and Si, and thereby contribute to the enhancement of mechanical strength and thermal conductivity. Also, the twin roll-type method is advantageous in that almost no coarse crystallization products having a size in the order of several micrometers (μm) are produced, which wear down the die when the fin material is worked by corrugation forming.

The molten metal temperature employed when casting is carried out by a twin roll-type continuous casting and rolling method is preferably in the range of 680° C. to 800° C. The molten metal temperature is the temperature of the head box that is disposed immediately before the molten metal supplying nozzle. If the molten metal temperature is too low, coarse intermetallic compounds are produced inside the molten metal supplying nozzle, and when those are mixed into the sheet-shaped ingot, the intermetallic compounds cause sheet cracking at the time of cold rolling. If the molten metal temperature is too high, aluminum is not sufficiently solidified between the rolls at the time of casting, and a normal sheet-shaped ingot cannot be obtained. A more preferred molten metal temperature is 700° C. to 750° C.

Then, the sheet-shaped ingot thus obtained is subjected to at least one steps of intermediate annealing in the mid course of rolling the ingot to the final sheet thickness. A first intermediate annealing among the intermediate annealing steps carried out one or more times is carried out in two stages with different retention temperatures, under the conditions that the retention temperature of the second stage is higher than the retention temperature of the first stage. The temperature difference is preferably 80° C. to 150° C.

When the fin material is subjected to annealing, the dispersed state of second phase particles that are precipitated in the fin material changes due to the operation temperature. When annealing is performed at a low temperature, precipitation of finely and densely dispersed second phase particles occurs in the fin material, and when annealing is performed at a high temperature, precipitation of coarsely and sparsely dispersed second phase particles occurs in the fin material. Thus, when annealing is performed at a low temperature, a large number of fine second phase particles that inhibit recrystallization at the time of braze-heating are precipitated out, and erosion of the fin is apt to occur. When annealing is performed at a high temperature, fine second phase particles that inhibit recrystallization at the time of braze-heating are hardly precipitated out, but the dispersion density of the second phase particles is become low, and the mechanical strength after braze-heating is lowered.

Thus, in the present invention, at least the first intermediate annealing is conducted to be retained at two stages of temperatures. First, a large number of fine second phase particles are precipitated out in the fin material, upon the retention at a low temperature of the first stage. Then, the fine second phase particles precipitated in the first stage are coarsened, upon the retention at a high temperature of the second stage, the density of fine second phase particles having a particle size of less than 0.1 μM that inhibit recrystallization is lowered, and the density of second phase particles having a particle size of 0.1 μm or more is raised, thereby for being possible to obtain a metallographic microstructure that does not undergo lowering in mechanical strength after braze-heating.

The retention temperature of the first stage is set to the range of 300° C. to 450° C. If the retention temperature is too low, precipitation of second phase particles upon annealing hardly occurs. If the retention temperature is too high, second phase particles that are already coarsened upon the first stage are sparsely precipitated out, and the mechanical strength after braze-heating is lowered. A more preferred temperature is in the range of 350° C. to 430° C.

The retention temperature of the second stage is a temperature that is higher than that of the first stage, and is set to the range of 430° C. to 580° C. If the retention temperature is too low, coarsening of the second phase particles that have been precipitated upon the first stage annealing does not occur, and a large number of second phase particles that inhibit recrystallization are dispersed, to cause erosion. If the retention temperature is too high, the second phase particles precipitated out upon the first stage are solid-solubilized again, and the distribution of the second phase particles finally obtained becomes a coarse and sparse distribution, thereby for lowering the mechanical strength after braze-heating. A more preferred temperature is in the range of 450° C. to 550° C.

The retention times for the first stage and the second stage each are preferably 1 to 10 hours. If the retention time is too short, a desired metallographic microstructure cannot be obtained, and if the retention time is too long, the effect reaches saturation, and thus it is not preferable from the viewpoint of productivity. A more preferred retention time is 2 to 5 hours.

In the case of performing the annealing after the second annealing or later, the conditions are not particularly limited, but it is preferable to perform the annealing at a temperature higher than or equal to the recrystallization temperature of the aluminum alloy utilized as the fin material. The annealing temperature is preferably 300° C. to 500° C., and the retention time is preferably 1 to 5 hours. More preferred conditions are: an annealing temperature of 350° C. to 450° C.; and a retention time of 1 to 3 hours.

After completion of the first intermediate annealing, at least one cold rolling is carried out. The annealing is performed appropriately, and then cold rolling to a final sheet thickness of 150 μm or less is performed. The final cold-rolling reduction ratio, which is the total rolling reduction ratio when rolling is performed to obtain the final sheet thickness after performing the final intermediate annealing, is set to 20% to 60%. If the final cold-rolling reduction ratio is too low, the driving force of recrystallization at the time of braze-heating is insufficient, recrystallization does not occur sufficiently, and erosion occurs. If the final cold-rolling reduction ratio is too high, the amount of strain introduced by rolling is so large that the mechanical strength of the fin material before braze-heating is made high, and the corrugation forming property is deteriorated. A more preferred final cold-rolling reduction ratio is 25% to 50%.

In order to control the final cold-rolling reduction ratio, at least one or more intermediate annealing is needed, but in the case of performing intermediate annealing only once, the total cold-rolling reduction ratio to obtain from the sheet thickness after casting to the sheet thickness for performing intermediate annealing is made very high. As such, when the cold-rolling reduction ratio is high, the material becomes hard due to rolling, and thereby cracking may occur in the coil edge portions. If the degree of cracking is large, there is a risk that sheet cracking may occur upon rolling. In order to suppress sheet cracking, it is effective to add a trimming step or an intermediate annealing step, in the mid course of the cold-rolling step, to make the material soft. In the case of performing intermediate annealing for the purpose of suppressing edge cracking, for example, a process may be adopted, which process has: performing the first annealing at the state where the sheet thickness is relatively thick; performing cold rolling; performing second annealing intended for controlling the final cold-rolling reduction ratio; and then rolling the sheet to the final sheet thickness by cold rolling.

The cooling speed to 250° C. after completion of the second-stage retention in the first annealing is set to 50° C./hour or less. When casting is performed by a twin roll-type continuous casting and rolling method, since the cooling speed at the time of casting is very large compared to the cooling speed of the DC casting method or the twin belt-type continuous casting and rolling method, the solid solubility of Mn or Si after casting is high. Since the initial solid solubility is high as such, the solid solubility of Mn or Si in the fin material after annealing changes largely depending on the cooling speed. When the cooling speed is set to 50° C./hour or less, the second phase particles formed by the second stage annealing grow further, and thereby the solid solubility of Mn or Si can be lowered. If the cooling speed is too high, the solid solubility of Mn or Si of the fin material after annealing is made high, and fine second phase particles that inhibit recrystallization as a result of solid-solubilized Mn or Si finely precipitating out in the later step, are precipitated out, to cause erosion. A more preferred cooling speed after annealing is 40° C./hour or less.

EXAMPLES

The present invention will be described in more detail based on the following examples, but the invention is not intended to be limited thereto.

First, aluminum alloys having the alloy compositions indicated in Table 1 were respectively produced by the production method shown in Table 2. In regard to the alloy compositions of Table 1, the symbol "–" indicates that the value is below the detection limit, and the term "balance" includes unavoidable impurities.

For a test material cast by the twin roll-type continuous casting and rolling method, a sheet-shaped ingot thus obtained was cold rolled, and subjected to intermediate annealing in a batch-type annealing furnace for a predetermined sheet thickness, followed by cold rolling to the final sheet thickness, to produce a fin material (tempering: H1n).

For a test material cast by the DC casting method, the thus-produced ingot was heated to 500° C. without performing any homogenization treatment, and then the ingot was rolled to a desired thickness by hot rolling, to produce a sheet material. Then, the sheet material thus obtained was cold rolled, subjected to intermediate annealing in a batch-type annealing furnace for a predetermined sheet thickness, and cold rolled to the final sheet thickness, to produce a fin material (tempering: H1n).

TABLE 1

| | Alloy No. | Alloy composition (mass %) | | | | |
|---|---|---|---|---|---|---|
| | | Si | Fe | Mn | Zn | Al |
| Example according to this invention | 1 | 0.5 | 0.5 | 1.2 | 1.5 | Balance |
| | 2 | 1.0 | 0.5 | 1.2 | 1.5 | Balance |
| | 3 | 1.5 | 0.5 | 1.2 | 1.5 | Balance |
| | 4 | 1.0 | 0.1 | 1.2 | 1.5 | Balance |
| | 5 | 1.0 | 1.0 | 1.2 | 1.5 | Balance |
| | 6 | 1.0 | 0.5 | 0.8 | 1.5 | Balance |
| | 7 | 1.0 | 0.5 | 1.8 | 1.5 | Balance |
| | 8 | 1.0 | 0.5 | 1.2 | 0.4 | Balance |
| | 9 | 1.0 | 0.5 | 1.2 | 1.0 | Balance |
| | 10 | 1.0 | 0.5 | 1.2 | 2.5 | Balance |
| Comparative example | 11 | 0.3 | 0.5 | 1.2 | 1.5 | Balance |
| | 12 | 1.7 | 0.5 | 1.2 | 1.5 | Balance |
| | 13 | 1.0 | 0.05 | 1.2 | 1.5 | Balance |
| | 14 | 1.0 | 1.2 | 1.2 | 1.5 | Balance |
| | 15 | 1.0 | 0.5 | 0.6 | 1.5 | Balance |
| | 16 | 1.0 | 0.5 | 2.0 | 1.5 | Balance |
| | 17 | 1.0 | 0.5 | 1.2 | 0.2 | Balance |
| | 18 | 1.0 | 0.5 | 1.2 | 2.7 | Balance |

TABLE 2

| | Production process No | Casting method | 1-st intermediate annealing: Anneal conditions 1-st stage | 1-st intermediate annealing: Anneal conditions 2-nd stage | 1-st intermediate annealing: Cooling speed (° C./h) | 2-nd intermediate annealing: Anneal conditions | Final cold-rolling reduction ratio (%) |
|---|---|---|---|---|---|---|---|
| Example according to this invention | 1 | Twin rolls | 300° C. × 2 h | 530° C. × 2 h | 30 | 350° C. × 2 h | 35 |
| | 2 | Twin rolls | 370° C. × 2 h | 530° C. × 2 h | 30 | 350° C. × 2 h | 35 |
| | 3 | Twin rolls | 450° C. × 2 h | 530° C. × 2 h | 30 | 350° C. × 2 h | 35 |
| | 4 | Twin rolls | 350° C. × 2 h | 430° C. × 2 h | 30 | 350° C. × 2 h | 35 |
| | 5 | Twin rolls | 370° C. × 2 h | 580° C. × 2 h | 30 | 350° C. × 2 h | 35 |
| | 6 | Twin rolls | 370° C. × 2 h | 530° C. × 2 h | 20 | 350° C. × 2 h | 35 |
| | 7 | Twin rolls | 370° C. × 2 h | 530° C. × 2 h | 50 | 350° C. × 2 h | 35 |
| | 8 | Twin rolls | 370° C. × 2 h | 530° C. × 2 h | 70 | 350° C. × 2 h | 35 |
| | 9 | Twin rolls | 370° C. × 2 h | 530° C. × 2 h | 30 | 350° C. × 2 h | 20 |
| | 10 | Twin rolls | 370° C. × 2 h | 530° C. × 2 h | 30 | 350° C. × 2 h | 60 |
| | 11 | Twin rolls | 370° C. × 2 h | 530° C. × 2 h | 30 | 430° C. × 2 h | 35 |
| | 12 | Twin rolls | 370° C. × 2 h | 530° C. × 2 h | 30 | — | 35 |
| Comparative example | 13 | Twin rolls | 270° C. × 2 h | 530° C. × 2 h | 30 | 350° C. × 2 h | 35 |
| | 14 | Twin rolls | 470° C. × 2 h | 530° C. × 2 h | 30 | 350° C. × 2 h | 35 |
| | 15 | Twin rolls | — | 530° C. × 2 h | 30 | 350° C. × 2 h | 35 |
| | 16 | Twin rolls | 370° C. × 2 h | 400° C. × 2 h | 30 | 350° C. × 2 h | 35 |
| | 17 | Twin rolls | 370° C. × 2 h | 600° C. × 2 h | 30 | 350° C. × 2 h | 35 |
| | 18 | Twin rolls | 270° C. × 2 h | 370° C. × 2 h | 30 | 350° C. × 2 h | 35 |
| | 19 | Twin rolls | 530° C. × 2 h | 370° C. × 2 h | 30 | 350° C. × 2 h | 35 |
| | 20 | Twin rolls | 370° C. × 2 h | — | 30 | 350° C. × 2 h | 35 |
| | 21 | Twin rolls | 370° C. × 2 h | 530° C. × 2 h | 30 | 350° C. × 2 h | 10 |
| | 22 | Twin rolls | 370° C. × 2 h | 530° C. × 2 h | 30 | 350° C. × 2 h | 70 |
| | 23 | DC | 370° C. × 2 h | 530° C. × 2 h | 30 | 350° C. × 2 h | 35 |

Then, the fin materials thus produced were used as test materials (Test Materials No. 1 to 48), and were subjected to braze-heating. Thereafter, for each of the test materials, evaluations on mechanical strength, electrical conductivity, brazing property, and corrosion resistance were carried out by the methods described below. The results are shown in Tables 3 and 4. Herein, the measurement of electrical conductivity was intended to evaluate the thermal conductivity of the fin materials, and in the case of aluminum alloys, it can be judged that a higher electrical conductivity is associated with a better thermal conductivity. In this specification, "braze-heating" implies that, unless otherwise specified, the simple substance of any of test material is heated at a temperature for a time period, under the heating conditions that assume the actual brazing of the fin materials.

[a] Density of Second Phase Particles Before Braze-Heating (Particles/mm$^2$):

The density of the second phase particles having a circle-equivalent diameter of less than 0.1 μm was investigated by making the transmission electron microscopy (TEM) observation of the fin material. The film thickness of the observed area was measured from equal-thickness fringes, and the TEM observation was made only at sites where the film thickness would be 0.1 to 0.3 μm. Further, the density of the second phase particles having a circle-equivalent diameter of 0.1 μm or more was investigated by making the SEM observation of the fin material cross-section. The density of the second phase particles before braze-heating was determined by subjecting the TEM and SEM photographs to the image analysis.

The observation was made in three viewing fields for each sample, and the TEM and SEM photographs for each viewing field were subjected to the image analysis, to determine the density of the second phase particles before braze-heating. The indicated density is an average value of the values determined from the three viewing fields for each sample.

[b] Corrugation Forming Property:

Each of the test materials was slit at a width of 16 mm, a corrugation forming machine was adjusted so as to give a fin ridge height of 5 mm and an interval of fin ridges of 2.5 mm, and the test material was subjected to corrugation forming, to thereby produce a fin with 100 ridges. Then, the fin ridge height was measured, and the case in which there were 10 or more fin ridges having a fin height of 5 mm±10% or more due to fluctuation in the fin height, was rated as poor "D", or the case in which the average interval of fin ridges was measured, and the average interval of fin ridges was 2.75 mm or more due to springback, was rated as poor "D". The cases other than those were rated as good "A" in terms of corrugation forming property.

[c] Grain Size (GS) Before Braze-Heating (μm):

A surface (L-LT face) of each of the test materials was subjected to electrolytic polishing and Barker etching, and then the grain microstructure thereof was observed with an optical microscope. The grain size was measured by a line intercept method of: drawing two diagonal lines on an optical microscopic photograph, and counting the number of grains that are intersected with those lines.

[d-1] Tensile Strength Before Braze-Heating, $TS_B$ (N/mm$^2$):

A tensile test was conducted for each of the test materials, according to JIS Z2241, at normal temperature, under the conditions of a tensile speed of 10 mm/min and a gauge length of 50 mm.

[d-2] Tensile Strength after Braze-Heating, $TS_A$ (N/mm$^2$):

Each of the test materials was braze-heated under the conditions of 600° C.×3 min, and then cooled at a cooling speed of 50° C./min. Then, the test material was left to stand for one week at room temperature, and this was used as a sample. Then, for each sample, the tensile test was conducted, according to JIS Z2241, at normal temperature, under the conditions of a tensile speed of 10 mm/min and a gauge length of 50 mm.

[e] Electrical Conductivity (EC, % IACS):

Each of the test materials was braze-heated under the conditions of 600° C.×3 min, and then cooled at a cooling speed of 50° C./min, which was used as a sample. For each sample, the electrical conductivity was determined by measuring the electrical resistance, according to JIS H0505, in a thermostat at 20° C. The unit % IACS used in this specification represents the electrical conductivity defined under JIS H0505.

[f] Whether there was Observed Diffusion and/or Melting of the Solder in the Fin, or not:

As illustrated in FIG. 1, each of the corrugation-formed test materials (fin 11), and a brazing sheet 12 were provided, respectively, which brazing sheet had a sheet thickness of 0.3 mm, and which brazing sheet had JIS3003 as a core alloy 13 that was clad at 10% cladding ratio on one surface thereof with a filler alloy 14 of JIS4045. Then, the test material 11 and the surface on the filler alloy 14 side of the brazing sheet 12 were superimposed, to form a core 10 for evaluation, as illustrated in FIG. 1, and this core 10 for evaluation was subjected to braze-heating under the conditions of 600° C.×3 min. Microscopic observation of a cross-section was conducted for the core 10 for evaluation, and whether there was observed diffusion and/or melting of the solder in the fin, or not, was checked. For the evaluation, the case without any of diffusion and melting of the solder was rated as satisfactory "A", and the case with any one or both of diffusion and melting of the solder was rated as poor "D".

[g] Evaluation of Self-Corrosion Resistance (Measurement an Amount of Corrosion Loss (%)):

Each of the test materials was braze-heated under the conditions of 600° C.×3 min, and then cooled at a cooling speed of 50° C./min, which was used as a sample. Then, for each sample, a brine spray test was conducted for 200 hours, according to JIS Z2371, and then the amount of the corrosion loss was measured.

[h] Natural Potential (mV):

Each of the test materials was braze-heated under the conditions of 600° C.×3 min, and then cooled at a cooling speed of 50° C./min, which was used as a sample. Then, for each sample, the natural potential (vs Ag/AgCl) of the fin was measured in a 5% aqueous NaCl solution at 25° C., to evaluate. For the evaluation, when the natural potential was lower than −720 mV, the sample was rated as satisfactory "A", and when the natural potential was higher than −720 mV, the sample was rate as poor "D".

TABLE 3

| Sample No. | | Alloy No. | Production process No. | Sheet thickness (μm) | $TS_B$ (N/mm$^2$) | $(TS_B - TS_A)/t$ | Corrugation forming property | Density of 2nd phase particles before braze-heating: Density of particles of less than 0.1 μm (particles/mm$^2$) | Density of 2nd phase particles before braze-heating: Density of particles of 0.1 μm or more (particles/mm$^2$) | GS before braze-heating (μm) |
|---|---|---|---|---|---|---|---|---|---|---|
| Example | 1 | 1 | 2 | 60 | 187 | 1.08 | A | $2.3 \times 10^6$ | $1.7 \times 10^5$ | 420 |
| according to | 2 | 2 | 2 | 60 | 190 | 0.93 | A | $3.3 \times 10^6$ | $1.8 \times 10^5$ | 450 |
| this | 3 | 3 | 2 | 60 | 197 | 0.83 | A | $4.5 \times 10^6$ | $2.2 \times 10^5$ | 480 |
| invention | 4 | 4 | 2 | 60 | 184 | 0.65 | A | $7.2 \times 10^6$ | $8.1 \times 10^4$ | 880 |

TABLE 3-continued

| | | | | | | | | | | |
|---|---|---|---|---|---|---|---|---|---|---|
| | 5 | 5 | 2 | 60 | 208 | 1.17 | A | $2.7 \times 10^6$ | $2.8 \times 10^5$ | 430 |
| | 6 | 6 | 2 | 60 | 176 | 0.87 | A | $2.1 \times 10^6$ | $1.5 \times 10^5$ | 350 |
| | 7 | 7 | 2 | 60 | 214 | 1.13 | A | $4.1 \times 10^6$ | $1.9 \times 10^5$ | 480 |
| | 8 | 8 | 2 | 60 | 188 | 0.88 | A | $3.4 \times 10^6$ | $1.8 \times 10^5$ | 460 |
| | 9 | 9 | 2 | 60 | 190 | 0.92 | A | $3.2 \times 10^6$ | $1.9 \times 10^5$ | 450 |
| | 10 | 10 | 2 | 60 | 191 | 0.95 | A | $3.2 \times 10^6$ | $1.8 \times 10^5$ | 450 |
| | 11 | 2 | 13 | 60 | 193 | 1.07 | A | $3.5 \times 10^6$ | $1.4 \times 10^5$ | 450 |
| | 12 | 2 | 17 | 60 | 180 | 0.97 | A | $1.5 \times 10^6$ | $2.0 \times 10^5$ | 450 |
| | 13 | 2 | 22 | 60 | 194 | 1.03 | A | $4.8 \times 10^6$ | $1.5 \times 10^5$ | 450 |
| Comparative | 14 | 11 | 2 | 60 | 182 | 1.08 | A | $1.2 \times 10^6$ | $1.7 \times 10^5$ | 400 |
| example | 15 | 12 | 2 | 60 | 204 | 0.88 | A | $6.2 \times 10^6$ | $2.4 \times 10^5$ | 490 |
| | 16 | 13 | 2 | 60 | 185 | 0.65 | D | $8.7 \times 10^6$ | $6.7 \times 10^4$ | 1150 |
| | 17 | 14 | 2 | 60 | 215 | 1.25 | A | $2.2 \times 10^6$ | $3.2 \times 10^5$ | 480 |
| | 18 | 15 | 2 | 60 | 175 | 0.93 | A | $1.7 \times 10^6$ | $1.4 \times 10^5$ | 360 |
| | 19 | 16 | 2 | 60 | 227 | 1.30 | A | $4.7 \times 10^6$ | $2.2 \times 10^5$ | 510 |
| | 20 | 17 | 2 | 60 | 191 | 0.93 | A | $3.5 \times 10^6$ | $1.9 \times 10^5$ | 460 |
| | 21 | 18 | 2 | 60 | 190 | 0.90 | A | $3.3 \times 10^6$ | $1.9 \times 10^5$ | 450 |

| | | Properties after braze-heating | | | | | |
|---|---|---|---|---|---|---|---|
| Sample No. | | $TS_A$ ($N/mm^2$) | EC (% IACS) | Whether there was observed diffusion and/or melting of the solder, or not | Amount of corrosion loss (%) | Natural potential (mV) | Remarks |
| Example | 1 | 122 | 42 | A | 3.2 | A | |
| according to | 2 | 134 | 44 | A | 3.3 | A | |
| this invention | 3 | 147 | 44 | A | 3.5 | A | |
| | 4 | 145 | 43 | A | 2.9 | A | |
| | 5 | 138 | 45 | A | 3.9 | A | |
| | 6 | 124 | 45 | A | 3.4 | A | |
| | 7 | 146 | 41 | A | 3.3 | A | |
| | 8 | 135 | 44 | A | 3.1 | A | |
| | 9 | 135 | 44 | A | 3.3 | A | |
| | 10 | 134 | 44 | A | 3.8 | A | |
| | 11 | 129 | 44 | A | 3.3 | A | |
| | 12 | 122 | 44 | A | 3.3 | A | |
| | 13 | 132 | 44 | A | 3.3 | A | |
| Comparative | 14 | 117 | 42 | A | 2.9 | A | |
| example | 15 | 151 | 43 | D | 3.8 | A | |
| | 16 | 146 | 43 | D | 2.5 | A | |
| | 17 | 140 | 45 | A | 3.7 | A | GC occurred |
| | 18 | 119 | 46 | D | 3.6 | A | |
| | 19 | 149 | 43 | A | 3.4 | A | GC occurred |
| | 20 | 135 | 45 | A | 3.1 | D | |
| | 21 | 136 | 43 | A | 4.2 | A | |

(Note)

'GC occurred': Giant intermetallic compounds (GC) were occurred upon casting.

TABLE 4

| | | | | | | | | Density of 2nd phase particles before braze-heating | | |
|---|---|---|---|---|---|---|---|---|---|---|
| Sample No. | | Alloy No. | Production process No. | Sheet thickness (μm) | $TS_B$ ($N/mm^2$) | $(TS_B - TS_A)/t$ | Corrugation forming property | Density of particles of less than 0.1 μm ($particles/mm^2$) | Density of particles of 0.1 μm or more ($particles/mm^2$) | GS before braze-heating (μm) |
| Example | 22 | 1 | 1 | 40 | 194 | 1.85 | A | $1.5 \times 10^6$ | $6.2 \times 10^4$ | 420 |
| according to | 23 | 1 | 2 | 40 | 184 | 1.55 | A | $2.3 \times 10^6$ | $1.7 \times 10^5$ | 430 |
| this invention | 24 | 1 | 3 | 40 | 181 | 1.50 | A | $1.2 \times 10^6$ | $7.3 \times 10^4$ | 400 |
| | 25 | 1 | 4 | 40 | 196 | 1.80 | A | $3.5 \times 10^6$ | $1.8 \times 10^5$ | 520 |
| | 26 | 1 | 5 | 40 | 174 | 1.33 | A | $7.8 \times 10^5$ | $5.5 \times 10^4$ | 340 |
| | 27 | 1 | 6 | 40 | 184 | 1.58 | A | $1.2 \times 10^6$ | $2.0 \times 10^5$ | 400 |
| | 28 | 1 | 7 | 40 | 190 | 1.68 | A | $2.5 \times 10^6$ | $1.5 \times 10^5$ | 440 |
| | 29 | 1 | 8 | 40 | 202 | 1.98 | A | $2.3 \times 10^6$ | $1.4 \times 10^5$ | 440 |
| | 30 | 1 | 9 | 40 | 175 | 1.35 | A | $2.3 \times 10^6$ | $1.7 \times 10^5$ | 460 |
| | 31 | 1 | 10 | 40 | 210 | 2.10 | A | $2.4 \times 10^6$ | $1.8 \times 10^5$ | 430 |
| | 32 | 1 | 11 | 40 | 182 | 1.50 | A | $2.0 \times 10^6$ | $1.7 \times 10^5$ | 430 |
| | 33 | 1 | 12 | 40 | 185 | 1.63 | A | $1.9 \times 10^6$ | $1.6 \times 10^5$ | 430 |
| | 34 | 1 | 2 | 50 | 185 | 1.26 | A | $2.3 \times 10^6$ | $1.7 \times 10^5$ | 440 |
| | 35 | 1 | 2 | 80 | 188 | 0.81 | A | $2.3 \times 10^6$ | $1.7 \times 10^5$ | 420 |
| | 36 | 1 | 2 | 150 | 184 | 0.40 | A | $2.3 \times 10^6$ | $1.7 \times 10^5$ | 440 |

TABLE 4-continued

| | | | | | | | | | | |
|---|---|---|---|---|---|---|---|---|---|---|
| Comparative example | 37 | 1 | 13 | 40 | 187 | 1.73 | A | $1.2 \times 10^6$ | $3.8 \times 10^4$ | 400 |
| | 38 | 1 | 14 | 40 | 177 | 1.50 | A | $8.9 \times 10^5$ | $3.3 \times 10^4$ | 320 |
| | 39 | 1 | 15 | 40 | 186 | 1.70 | A | $7.7 \times 10^5$ | $4.2 \times 10^4$ | 440 |
| | 40 | 1 | 16 | 40 | 225 | 2.48 | D | $3.5 \times 10^7$ | $5.4 \times 10^4$ | Remained fiber structure |
| | 41 | 1 | 17 | 40 | 180 | 1.63 | A | $5.4 \times 10^5$ | $3.9 \times 10^4$ | 330 |
| | 42 | 1 | 18 | 40 | 238 | 2.83 | D | $6.8 \times 10^7$ | $2.8 \times 10^4$ | Remained fiber structure |
| | 43 | 1 | 19 | 40 | 181 | 1.60 | A | $6.9 \times 10^5$ | $3.8 \times 10^4$ | 420 |
| | 44 | 1 | 20 | 40 | 229 | 2.53 | D | $6.5 \times 10^7$ | $2.8 \times 10^4$ | Remained fiber structure |
| | 45 | 1 | 21 | 40 | 168 | 1.08 | A | $2.4 \times 10^6$ | $1.8 \times 10^5$ | 450 |
| | 46 | 1 | 22 | 40 | 216 | 2.23 | D | $2.3 \times 10^6$ | $1.7 \times 10^5$ | 420 |
| | 47 | 1 | 23 | 40 | 167 | 1.35 | A | $7.7 \times 10^5$ | $1.2 \times 10^4$ | 120 |
| | 48 | 1 | 21 | 150 | 170 | 0.29 | A | $2.5 \times 10^6$ | $1.8 \times 10^5$ | 420 |

| | | Properties after braze-heating | | | | | |
|---|---|---|---|---|---|---|---|
| Sample No. | | $TS_A$ ($N/mm^2$) | EC (% IACSZ) | Whether there was observed diffusion and/or melting of the solder, or not | Amount of corrosion loss (%) | Natural potential (mV) | Remarks |
| Example according to this invention | 22 | 120 | 41 | A | 3.2 | A | |
| | 23 | 122 | 42 | A | 3.2 | A | |
| | 24 | 121 | 42 | A | 3.4 | A | |
| | 25 | 124 | 42 | A | 3.2 | A | |
| | 26 | 121 | 43 | A | 3.3 | A | |
| | 27 | 121 | 42 | A | 3.3 | A | |
| | 28 | 123 | 42 | A | 3.1 | A | |
| | 29 | 123 | 42 | A | 3.2 | A | |
| | 30 | 121 | 42 | A | 3.5 | A | |
| | 31 | 126 | 42 | A | 3.2 | A | |
| | 32 | 122 | 42 | A | 3.2 | A | |
| | 33 | 120 | 42 | A | 3.0 | A | |
| | 34 | 122 | 42 | A | 3.3 | A | |
| | 35 | 123 | 42 | A | 3.1 | A | |
| | 36 | 124 | 42 | A | 2.9 | A | |
| Comparative example | 37 | 118 | 41 | A | 3.3 | A | |
| | 38 | 117 | 42 | A | 3.3 | A | |
| | 39 | 118 | 42 | A | 3.2 | A | |
| | 40 | 126 | 41 | A | 3.1 | A | |
| | 41 | 115 | 43 | A | 3.2 | A | |
| | 42 | 125 | 42 | A | 3.3 | A | |
| | 43 | 117 | 42 | A | 3.2 | A | |
| | 44 | 128 | 42 | A | 3.3 | A | |
| | 45 | 125 | 42 | D | 3.2 | A | |
| | 46 | 127 | 42 | D | 3.3 | A | |
| | 47 | 113 | 39 | D | 3.3 | A | |
| | 48 | 127 | 42 | D | 3.0 | A | |

As is apparent from the results of Tables 3 and 4, Test Materials Nos. 1 to 13 of the Examples according to the present invention, and Test Materials Nos. 22 to 36 obtained by the method of producing the fin of the present invention, each was excellent in the characteristics. That is, the grain size before braze-heating was 1,000 μm or less, the corrugation forming property was satisfactory, and the tensile strength after braze-heating was high such as 120 $N/mm^2$ or more. Further, no solder diffusion or melting of the solder in the fin occurred, to be good in the brazing property, and the amount of corrosion loss was less than 4.0%. Further, the natural potential was lower than −720 mV, thereby for resulting to show the sacrificial anode effect secured.

On the contrary, Comparative Examples had any of problems such as described below.

Comparative Examples 14 to 21 shown in Table 3 each represent the cases in which the alloy composition was not as defined in the present invention.

Test Material No. 14 had a Si content that was too small, and thus, the test material was poor in tensile strength after braze-heating, and was insufficient in mechanical strength to be used as an intended fin.

In Test Material No. 15, the content of elemental Si was too high, which lowers the melting point, to occur melting of the fin.

In Test Material No. 16, the content of Fe was too small, and thus the grain size before braze-heating was larger than 1,000 μm, and this test material was poor in corrugation forming property. Further, since the content of Fe was too small, the amount of the Al—Fe—Si-based compounds were made small, the amount of Si solid solution was made large, which lowers the melting point of the fin, to occur melting of the fin.

In Test Material No. 17, since the Fe content was too large, and in Test Material No. 19, since the Mn content was too large, respectively, giant intermetallic compounds (GC) were occurred at the time of casting.

In Test Material No. 18, since the Mn content was too small, the test material was poor in tensile strength after braze-heating, and was insufficient in mechanical strength to be used as an intended fin. In addition to those, the amount of the Al—Mn—Si-based compounds were made small, the amount of Si solid solution was made large, to occur melting of the fin.

In Test Material No. 20, since the Zn content was too small, the natural potential of the fin could not be lowered sufficiently.

In Test Material No. 21, since the Zn content was too large, the corrosion speed was fast, and the amount of corrosion loss was made large.

Comparative Examples 37 to 48 indicated in Table 4 each represent the cases in which the fin production method was not as defined in the present invention.

In the fin production method for Test Material No. 37, since the first-stage annealing temperature of the first intermediate annealing was too low, the density of the second phase particles having a particle size of 0.1 μm or more before braze-heating was not in the range as defined for the intended fin according to the present invention. Further, the tensile strength of the fin after braze-heating was also insufficient.

In the fin production method for Test Material No. 38, since the first-stage annealing temperature of the first intermediate annealing was too high, the density of the second phase particles having a particle size of 0.1 μm or more before braze-heating was not in the range as defined for the intended fin according to the present invention. Further, the tensile strength of the fin after braze-heating was also insufficient.

In the fin production method for Test Material No. 39, since the first intermediate annealing was not performed in two stages, the density of the second phase particles having a particle size of 0.1 μm or more before braze-heating was not in the range as defined for the intended fin according to the present invention. Further, the tensile strength of the fin after braze-heating was also insufficient.

In the fin production method for Test Material No. 40, since the second-stage annealing temperature of the first intermediate annealing was too low, the density of the second phase particles having a particle size of less than 0.1 μm before braze-heating was high, the predetermined value of $(TS_B-TS_A)/t$ before and after braze-heating was not satisfied, and this test material was poor in the corrugation forming property. In this Test Material No. 40, there was a residual fibrous microstructure.

In the fin production method for Test Material No. 41, since the second-stage annealing temperature of the first intermediate annealing was too high, the density of the second phase particles having a particle size of 0.1 μm or more before braze-heating was not in the range as defined for the intended fin according to the present invention. Further, the tensile strength of the fin after braze-heating was also insufficient.

In the fin production method for Test Material No. 42, since the first-stage annealing temperature and the second-stage annealing temperature of the first intermediate annealing each were too low, the density of the second phase particles having a particle size of less than 0.1 μm before braze-heating was high, the density of the second phase particles having a particle size of 0.1 μm or more before braze-heating was low, the predetermined value of $(TS_B-TS_A)/t$ before and after braze-heating was large, and the corrugation forming property was poor. In this fin production method for Test Material No. 42, there was a residual fibrous microstructure.

In the fin production method for Test Material No. 43, since the first-stage annealing temperature of the first intermediate annealing was too high and the second-stage annealing temperature was too low, the density of the second phase particles having a particle size of 0.1 μm or more before braze-heating was not in the range as defined for the intended fin according to the present invention. Further, the tensile strength of the fin after braze-heating was also insufficient.

In the fin production method for Test Material No. 44, since the first intermediate annealing was not conducted in two stages, the density of the second phase particles having a particle size of less than 0.1 μm before braze-heating was high, the density of the second phase particles having a particle size of 0.1 μm or more before braze-heating was low, the predetermined value of $(TS_B-TS_A)/t$ before and after braze-heating was large, and the corrugation forming property was poor. In this Test Material No. 44, there was a residual fibrous microstructure.

In the fin production methods for Test Materials Nos. 45 and 48, since the final cold-rolling reduction ratio each were too low, solder diffusion occurred due to the insufficiency of the driving force for recrystallization at the time of braze-heating in the respective cases. Further, Test Material No. 48 did not satisfy the predetermined value of $(TS_B-TS_A)/t$ before and after braze-heating.

In the fin production method for Test Material No. 46, since the final cold-rolling reduction ratio was too high, the grains after braze-heating became fine, the predetermined value of $(TS_B-TS_A)/t$ before and after braze-heating was large, the corrugation forming property was poor, and any one of solder diffusion and solder melting occurred.

In the fin production method for Test Material No. 47, since the casting method was the DC method, the density of the second phase particles having a particle size of 0.1 μm or more before braze-heating was low, and the grains after braze-heating became fine. Thus, the tensile strength of the fin after braze-heating was insufficient, and solder diffusion occurred.

Having described our invention as related to the present embodiments, it is our intention that the invention not be limited by any of the details of the description, unless otherwise specified, but rather be construed broadly within its spirit and scope as set out in the accompanying claims.

REFERENCE SIGNS LIST

10 Core for evaluation
11 Fin material
12 Brazing sheet
13 Core alloy
14 Filler alloy

The invention claimed is:

1. An aluminum alloy fin material for heat exchangers, consisting essentially of: 0.5 to 1.5 mass % of Si; 0.1 to 1.0 mass % of Fe; 0.8 to 1.8 mass % of Mn; and 0.4 to 2.5 mass % of Zn, with the balance being Al and unavoidable impurities, wherein a metallographic microstructure before braze-heating is such that a density of second phase particles having a circle-equivalent diameter of less than 0.1 μm is less than $1\times10^7$ particles/mm$^2$, and that a density of second phase particles having a circle-equivalent diameter of 0.1 μm or more is $5\times10^4$ particles/mm$^2$ or more, wherein a tensile strength before braze-heating, $TS_B$ (N/mm$^2$), a tensile strength after braze-heating, $TS_A$ (N/mm$^2$), and a sheet thickness of the fin material, t (μm), satisfy a relationship: $0.4\ (TS_B-TS_A)/t\leq2.1$, and wherein the sheet thickness is 150 μm or less.

2. A method of producing an aluminum alloy fin material for heat exchangers, comprising:

casting an aluminum alloy raw material consisting essentially of: 0.5 to 1.5 mass % of Si; 0.1 to 1.0 mass % of Fe; 0.8 to 1.8 mass % of Mn; and 0.4 to 2.5 mass % of Zn, with the balance being Al and unavoidable impurities, by a twin roll-type continuous casting and rolling method;

at least one intermediate annealing, in which a first annealing of the intermediate annealing is carried out in two stages at different retention temperatures, a retention temperature of a second stage is higher than a retention temperature of a first stage, the retention temperature of the first stage is 300° C. to 450° C., the retention temperature of the second stage is 430° C. to 580° C.; and final cold-rolling at a rolling reduction ratio of 20% to 60%, after performing the intermediate annealing;

wherein a metallographic microstructure before braze-heating is such that a density of second phase particles having a circle-equivalent diameter of less than 0.1 μm is less than $1\times10^7$ particles/mm$^2$, and that a density of second phase particles having a circle-equivalent diameter of 0.1 μm or more is $5\times10^4$ particles/mm$^2$ or more, wherein a tensile strength before braze-heating, $TS_B$ (N/mm$^2$), a tensile strength after braze-heating, $TS_A$ (N/mm$^2$), and a sheet thickness of the fin material, t (μm), satisfy a relationship: $0.4\leq(TS_B-TS_A)/t\leq2.1$, and wherein the sheet thickness is 150 μm or less.

3. The method of producing an aluminum alloy fin material for heat exchangers according to claim 2, wherein a cooling speed from the time point of completion of a retention for annealing of the second stage to 250° C. is set to 50° C./hour or less.

* * * * *